US011214053B2

(12) United States Patent
Siemer et al.

(10) Patent No.: US 11,214,053 B2
(45) Date of Patent: Jan. 4, 2022

(54) PRINTING PRESS AND METHOD FOR PRODUCING PRINTED PRODUCTS

(71) Applicant: KOENIG & BAUER AG, Würzburg (DE)

(72) Inventors: Axel Siemer, Hettstadt (DE); Helmut Endres, Zellingen (DE); Manfred Kohrmann, Helmstadt / Holzkirchhausen (DE); Roman Rauhofer, Rohrbach (AT)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/287,159

(22) PCT Filed: Mar. 13, 2020

(86) PCT No.: PCT/EP2020/056903
§ 371 (c)(1),
(2) Date: Apr. 21, 2021

(87) PCT Pub. No.: WO2020/200703
PCT Pub. Date: Oct. 8, 2020

(65) Prior Publication Data

US 2021/0309005 A1 Oct. 7, 2021

(30) Foreign Application Priority Data

Apr. 3, 2019 (DE) ..... 10 2019 108 765.1

(51) Int. Cl.
*B41F 11/02* (2006.01)
*B41F 21/00* (2006.01)
*B41F 23/04* (2006.01)

(52) U.S. Cl.
CPC ..... *B41F 11/02* (2013.01); *B41F 21/005* (2013.01); *B41F 23/0479* (2013.01); *B41F 23/0483* (2013.01); *B41P 2200/40* (2013.01)

(58) Field of Classification Search
CPC .... B41F 11/02; B41F 21/005; B41F 23/0479; B41F 23/0483; B41P 2200/40
See application file for complete search history.

(56) References Cited

U.S. PATENT DOCUMENTS 3,342,129 A 9/1967 William
5,275,103 A * 1/1994 Hahne ..... B41F 23/0479 101/487

(Continued)

FOREIGN PATENT DOCUMENTS

DE 9419702 U1 3/1995
DE 102008001165 A1 10/2009

(Continued)

OTHER PUBLICATIONS

International Search Report of PCT/EP2020/056903 dated May 28, 2020.

*Primary Examiner* — David H Banh
(74) *Attorney, Agent, or Firm* — Mattingly & Malur, PC

(57) ABSTRACT

A printing press has at least one printing unit that comprises one or more printing couples, by the use of which printing press, sheet-format substrate can be printed on at least one side in at least one printing nip. The printing press has at least one product receiving unit, in which the printed sheet-format substrate can be collected to form bundles of products or intermediate products. A rotatable cooling cylinder, for guiding or conveying the sheet-format substrate, is located upstream of the product receiving unit in the substrate path. At least one first electrode is arranged on, and is directed towards the substrate path section that runs over a circumferential section of the cooling cylinder. When an (Continued)

electric voltage is applied to the substrate path, substrate being guided along the substrate path past the electrode is or can be electrostatically charged.

15 Claims, 5 Drawing Sheets

(56) References Cited

U.S. PATENT DOCUMENTS 5,337,134 A * 8/1994 Sato ..... B65H 15/00 271/186
5,345,295 A * 9/1994 Takano ..... G03G 15/6535 399/125
5,580,688 A * 12/1996 Hirt ..... B41C 1/1058 430/49.1
5,787,809 A 8/1998 Bosse
6,064,470 A * 5/2000 Karashima ..... G03G 15/168 399/101
6,606,948 B1 * 8/2003 Austin ..... B41F 23/0479 101/216
10,220,606 B2 3/2019 Franz et al.
10,265,944 B2 4/2019 Franz et al.
10,768,558 B2 * 9/2020 Mandai ..... G03G 21/14
2003/0178183 A1 * 9/2003 Asemyr ..... B29C 48/92 165/90
2005/0106367 A1 * 5/2005 Raksha ..... B05D 5/061 428/199
2007/0092310 A1 * 4/2007 Tsujita ..... G03G 15/6535 399/315
2010/0296852 A1 * 11/2010 Higaki ..... B65H 3/0669 399/390
2013/0213246 A1 * 8/2013 Schaede ..... B65H 29/042 101/76
2016/0288532 A1 * 10/2016 Kobayashi ..... B41J 11/002
2018/0043679 A1 2/2018 Franz et al.
2018/0079195 A1 3/2018 Franz et al.
2018/0079196 A1 3/2018 Franz et al.

FOREIGN PATENT DOCUMENTS

DE 102015205066 A1 9/2016
EP 1795347 A2 6/2007
EP 2100736 A1 9/2009
EP 3130468 A2 2/2017
EP 2574463 B1 4/2018
WO 2016067247 A1 5/2016

* cited by examiner

PRINTING PRESS AND METHOD FOR PRODUCING PRINTED PRODUCTS

CROSS-REFERENCE TO RELATED APPLICATIONS

This application is the U.S. national phase, under 35 USC § 371, of PCT/EP2020/056903, filed Mar. 13, 2020; published as WO 2020/200703 A1 on Oct. 8, 2020 and claiming priority to DE 10 2019 108 765.1, filed Apr. 3, 2019, the disclosures of which are expressly incorporated herein in their entireties by reference

FIELD OF THE INVENTION

The present invention relates to a printing press, in particular a security printing press, and a method for producing printed products, in particular securities or intermediate security products. The printing press has at least one printing unit that comprises one or more printing couples, by the use of which, sheet-format substrate can be printed on at least one side in at least one printing nip. The printing press also has at least one product receiving unit, in which the printed sheet-format substrate can be collected to form bundles of products or intermediate products. A rotatable cooling cylinder, for guiding or conveying the sheet-format substrate, is located upstream of the product receiving unit in the substrate path. In a method for producing products or intermediate products in such a printing press, the substrate to be processed is supplied on an intake side by a printing material infeed. The substrate is printed in a printing unit by the use of one or more printing couples, and the printed substrate is conveyed along a transport path over a cooled supporting or guiding surface of a guiding or transport device, configured as a cooling cylinder, to a product receiving unit where it is combined to form a printed product.

BACKGROUND OF THE INVENTION

WO 2016/067247 A1 discloses a screen printing press that has, in the substrate path downstream of a screen printing unit, a device for aligning magnetic or magnetizable particles contained in the printing ink or the varnish. Said device comprises a cylinder, which has a plurality of elements on its circumference that induce a magnetic field, and a dryer directed toward the transport path in the region of the cylinder. Another dryer for final drying is preferably provided downstream in the substrate path.

EP 3 130 468 A2 discloses a combination printing press with a first printing unit comprising numbering printing couples and with varnishing devices for recto and verso varnishing. Each varnished side is then dried by UV radiation. In one embodiment variant, a transfer drum that follows the recto and verso varnishing can be configured as a cooling roller, in another variant it can be configured as an inspection cylinder.

In a printing press that operates by the lithographic printing method, disclosed in U.S. Pat. No. 3,342,129 A, a sheet is pressed electrostatically against an impression cylinder by applying an electric field between the needles of a high voltage electrode and the grounded impression cylinder.

EP 2 574 463 B1 also discloses an offset sheet-fed printing press and a flexographic printing press, each with at least one printing unit having an inkjet print head, in which the printing sheet is first set onto the impression cylinder by a pressing roller, after which the printing sheet is pressed onto the impression cylinder by electrostatic forces. This is assisted by directing a jet of air into the roller nip between impression cylinder and pressing roller.

EP 1 795 347 A2 relates to cooling roller stands of a web-fed printing press, in which a pressing roller is provided on one of the cooling rollers and is used to press the web against the cooling roller. In a refinement intended to further improve the system, the pressing roller acts as an electrode to which direct voltage is applied and forms an electric field between itself and the cooling roller.

For the web-fed printing press in DE 94 19 702 U1, it is proposed that a charging electrode should be provided in the web path downstream of a last deflection point and upstream of a first cooling roller.

EP 2 100 736 A1 discloses a cooling cylinder downstream of a work station in which film is applied to substrate sheets, DE 10 2015 205 066 A1 discloses a rotary body that can be set against an impression cylinder, and which in one embodiment can be configured for cooling, and DE 10 2008 001 165 A1 discloses an electrode provided on the outer circumference of a printing cylinder.

SUMMARY OF THE INVENTION

The object of the present invention is to create a printing press, in particular a security printing press, and a method for producing printed products, in particular securities or intermediate security products.

The object is attained according to the invention by the provision of the printing press having at least a first electrode arranged on, and directed towards the substrate path section that runs over a circumferential surface of the cooling cylinder. When an electric voltage is applied to the substrate path, substrate being guided along the substrate path past the electrode is or can be electrostatically charged. The positioning of the substrate on the cooling supporting or guiding surface is at least assisted by electrostatic forces.

The advantages to be achieved with the invention are, in particular, that products in the form of intermediate products, for example, in particular printed products, can be further processed without an extended rest period and/or without problematic blocking. In the following, printed products are understood to include intermediate products intended for further processing. The solution according to the invention ensures an effective transfer of heat even at high press speeds and, as a result, guarantees the aforementioned avoidance of extended periods of rest and/or problematic blocking, e.g. even at higher press speeds.

Because an at least largely thorough drying is carried out, the risk of damage to the freshly printed products caused by sticking to layers lying below or above them is greatly reduced and/or products can be collected to form numerous larger bundles.

Particularly in the production of securities or intermediate security products, the substrate is printed and treated multiple times in multiple successive steps. If the substrate will be printed again, for example, it is particularly advantageous for the substrate to be returned as quickly as possible to a state in which it can be treated in the next unit. For example, after the substrate is printed in the screen printing process, it will subsequently be printed, for example, with alphanumeric strings of characters—e.g. in letterpress or letterset—in a press that has one or more numbering printing units.

Thus, the solution according to the invention enables an at least largely thorough drying to be carried out, even at high production rates, without the printing substrate pile having to cool down first in climate-controlled spaces.

A particularly effective transfer of heat for the purpose of cooling the substrate is achieved by a full-surface nestling of the substrate, induced by electrostatic forces, against a stationary or preferably moved-along, cooled supporting and/or guiding surface of a guiding and/or transport means that guides and/or conveys the substrate, in particular the circumferential surface of a rotating transport means that is provided for cooling, e.g. a cooling cylinder.

A printing press, comprises such a guiding and/or transport means for guiding and/or conveying the substrate, in particular to be provided downstream of the last printing nip and having a stationary or preferably moved-along, cooled or coolable supporting surface and/or guiding surface, in particular a rotating transport means, e.g. a transport cylinder configured as a cooling cylinder, for example, having at least one circumferential section to be cooled from the inside by coolant, over which the substrate is guided and/or conveyed from a point at which the substrate runs up onto the transport means to a point at which the substrate runs back off of the circumferential surface of the transport means. In the case of a web-format substrate, the substrate wraps around the preferably rotating guiding and/or transport means over a length or in an angular segment that extends between the points where substrate runs up onto and off of said transport means, wherein in the case of a rotating transport means, the circumferential section to be cooled preferably extends around the entire circumference. In an advantageous configuration of a substrate in sheet format, the substrate sheet is received by the rotating transport means in the region of the point where said sheet runs up onto said transport means from an upstream transport means, and the sheet is delivered or transferred to a subsequent transport means in the region of the point where said sheet runs off of said rotating transport means. According to the invention, directly at the point on the substrate path where the substrate runs up onto the stationary or preferably moved-along, cooled supporting and/or guiding surface of the guiding and/or transport means, in particular onto the outer circumference of the coolable rotating transport means, and/or in the region on the substrate path where the substrate is received, or at a point on the substrate path downstream of said region, an electrode is arranged directed toward the substrate path in such a way that when an electric voltage is applied, in particular an operating voltage, substrate that is guided on the substrate path past the electrode, in particular a substrate sheet that is guided past the electrode, is or can be electrostatically charged. In this way, the substrate is better positioned against the supporting and/or guiding surface. In a refinement, another electrode of this type directed toward the substrate path on the cylinder circumference may be provided at a distance downstream in the circumferential direction.

In a particularly advantageous embodiment, the printing press is embodied as a security printing press and/or as a sheet-fed printing press for processing sheet-format substrate.

Further details and variants may be found in the following exemplary embodiments and can be combined per se with one another and/or with any of the above-described embodiments of the device, the machine, or the method, provided such combination is not contradicted.

BRIEF DESCRIPTION OF THE DRAWINGS

Exemplary embodiments of the invention are illustrated in the set of drawings and will be described in greater detail in the following.

The drawings show.

DESCRIPTION OF THE PREFERRED EMBODIMENT

Figure 1:
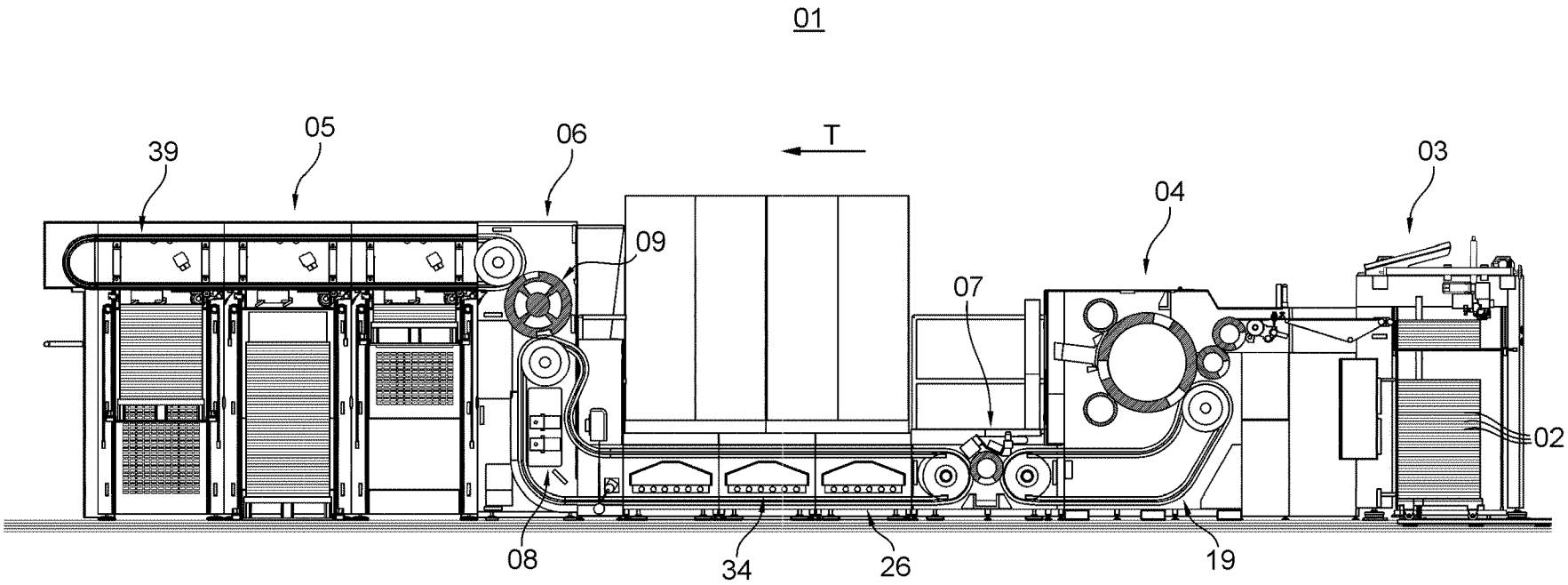
FIG. 1 an exemplary embodiment of a printing press with a printing unit and an apparatus for conditioning printed substrate, and with a device for aligning magnetic or magnetizable particles, provided in a preferred embodiment in the transport path between these.

A printing press 01, in particular a security printing press 01, for producing printed products or intermediate printed products, in particular securities or security intermediate products, such as preferably sheets with printed images of banknotes on a substrate 02, e.g. a web-format or sheet-format printing material 02, comprises a printing material infeed 03, e.g. a roll unwinder or preferably a sheet feeder 03, at least one application device 04, e.g. at least one printing unit 04, by means of which coating medium, e.g. printing ink or varnish, can be applied in the form of printed image elements at at least one application point, e.g. printing nip, on at least a first side of the substrate 02, e.g. the printing material 02, over the entire surface or in partial areas, in order to form image elements, along with at least one product receiving unit 05 for receiving the printing material 02 that has been treated and/or processed in the press 01 to form a product or intermediate product, e.g. a winder in the case of web-format printing material 02 or a pile delivery 05 in the preferred case of sheet-format printing material 02 (see, e.g. FIG. 1). In one advantageous embodiment of the printing press 01, the application device 04 can apply optically variable coating medium, e.g. optically variable printing ink or varnish, in the form of printed image elements in at least one application point, e.g. printing nip, to at least a first side of the substrate 02, e.g. the printing material 02, over the entire surface or in partial areas in order to form optically variable image elements. For this preferred case of the printing press 01, an apparatus for the alignment 07 of particles that are contained in the optically variable coating medium applied to the substrate 02 and that are responsible for the optical variability is provided in the substrate path between application device 04 and product receiving unit 05. In the following, this apparatus for alignment 07 is also referred to simply as alignment apparatus 07. As particles that are responsible for optical variability, magnetic or magnetizable, non-spherical particles, e.g. pigment particles, in the following also referred to simply as magnetic flakes, are contained in the coating medium, e.g. the printing ink or the varnish.

At least one cooling device 09 is provided downstream of, for example, the last or sole printing unit 04 of the printing press 01 in the substrate path and upstream of a stacking point in the product receiving unit 05 in the substrate path. This cooling device 09 may be part of an apparatus 06 for conditioning the printed substrate 02, or conditioning apparatus 06 for short, which in addition to the cooling device 09 comprises one or more drying and/or curing devices 08; 34 upstream, which will be described in greater detail below. If an alignment apparatus 07 is provided in the substrate path, the cooling device 09 or conditioning apparatus 06 is preferably situated downstream of this in the substrate path.

For the alternative case of a hybrid printing press, in which the aforementioned printing unit 04 of the first type is followed in the substrate path by a printing unit of a different type, in addition to an optional alignment apparatus 07, the cooling device 09 or conditioning apparatus 06 is likewise provided in the substrate path between this first printing unit 04 and the product receiving unit 05. Such a conditioning apparatus 06 for conditioning the substrate 02 can generally also be provided between the printing unit 04 of the first type and a printing unit of another type and/or between the printing unit of the other type, e.g. the last printing unit in the press, and the product receiving unit 05. In such a hybrid printing press, the printing unit 04 of the first type may be a printing unit 04 having one or more printing couples that operate according to the offset method, a printing unit having one or more printing couples that operate according to the gravure printing method, in particular the intaglio printing method, or preferably a printing unit 04 having one or more printing couples 11; 12 that operate according to the screen printing method. Assuming that the second type is a different type from the first type, the printing unit of the second type may be a printing unit having one or more printing couples that operate according to the gravure printing method, in particular the intaglio printing method, a printing unit having one or more printing couples that operate according to the screen printing method, or a printing unit having one or more printing couples, in particular one or more numbering units, that operate according to a letterpress method, in particular the letterset method. However, the teaching relating to a hybrid printing press is not restricted to only two printing units of different types.

As stated above, the conditioning apparatus 06 preferably comprises at least one drying and/or curing device 08, located upstream of the cooling device 09 and directed toward the substrate path, e.g. a dryer 08, for example a radiation dryer 08 having one or more radiation sources 13 for IR or preferably UV radiation, e.g. IR or preferably UV light sources, preferably operating based on electromagnetic radiation. If multiple radiation sources 13; 13' are provided, two radiation sources 13; 13' of different radiation spectra, in particular UV radiation spectra, may be provided.

The drying and/or curing device 08 and the cooling device 09 may be arranged in the substrate path immediately following one another, e.g. without a unit located therebetween, and/or preferably in the same structural unit, for example in a structural unit in the form of a conditioning apparatus 06 that connects the upstream conveyor line to the intake to the product receiving unit 05, for example in a module 06, e.g. conditioning module 06, i.e. which has its own frame, for example, and/or which can be pre-installed and/or removed as a complete unit, except for the connections to the upstream and downstream conveyor devices 19; 26; 39, or said devices may optionally be provided in the transport path as independent units arranged spaced apart from one another in the substrate path.

The conditioning apparatus 06 may be located as an independent structural unit, e.g. in an aforementioned module 06, upstream of the product receiving unit 05 or may be integrated into the product receiving unit 05 in a region on the intake side thereof.

The press 01 is preferably embodied for the production of securities, in particular banknotes, or intermediate products for such securities, e.g. printed images of a plurality of such securities as substrate sections containing copies, in particular substrate sheets 02. The substrate 02, e.g. the printing material 02, may be formed, e.g., from cellulose fiber-based or preferably cotton fiber-based paper, plastic polymer, or a hybrid product of these. Before being coated in the aforementioned application device 04, it may be uncoated or may already have been coated, and may be unprinted or may already have been printed one or more times or otherwise mechanically processed. On a longitudinal section of web-format substrate 02 or on a sheet of a sheet-format substrate 02, multiple copies, e.g. banknotes to be produced, preferably are arranged, or will be arranged during the course of processing of the substrate 02, side by side in a row, and multiple such rows of copies or of the print image thereof are or will be arranged one behind the other in the direction of transport T.

As mentioned above, the machine 01 embodied as a printing press 01 can generally comprise one or more printing units 04 of the same or of different types, with one or more printing couples of any printing method. In a preferred embodiment, however, it comprises a printing unit 04 having at least one printing couple 11; 12 that operates according to the flexographic printing method or preferably according to the screen printing method, by means of which optically variable coating medium is or can be applied to a first side of the printing material 02. The printing methods mentioned, in particular the screen printing method, allow a greater layer thickness to be applied as compared with other printing methods. The term "first side" of the substrate 02 or printing material 02 has been chosen arbitrarily and is intended to denote the specific side of the printing material 02 to which the optically variable coating medium is or was or can be applied.

Figure 2:
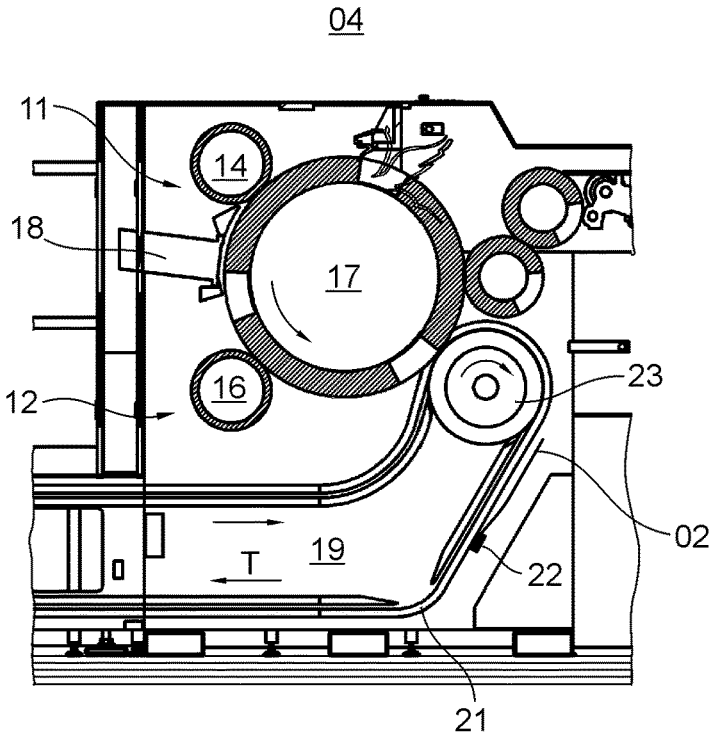
FIG. 2 an enlarged illustration of the printing unit from FIG. 1.

The web-format or preferably sheet-format printing material 02 is or can be fed from the printing material infeed 03, optionally via additional printing or processing units, to the printing unit 04 that applies the optically variable coating medium, e.g. flexographic or in particular screen printing unit 04, which has at least one printing couple 11; 12, e.g. flexographic or in particular screen printing couple 11; 12. In the illustrated and advantageous embodiment, two screen printing couples 11; 12 are provided, which are preferably combined in the same printing unit 04 and which form, each between a respective forme cylinder 14; 16, e.g. a screen printing cylinder 14; 16, and a common impression cylinder 17, two printing nips for the same side of the printing material 02, in this case the first side (see, e.g., FIG. 2). In the transport path between the two printing nips, a drying and/or curing device 18, e.g. a radiation dryer 18, in particular a UV dryer 18, in particular in the form of a UV LED dryer, can be provided, directed toward the first side of a printing material 02 to be conveyed through the printing unit 04. Optically variable coating medium may be applicable or applied by only one or by both of the screen printing couples 11; 12.

From the printing unit 04 that applies optically variable coating medium, for example, the printing material 02 can be fed via conveying means of at least one conveyor device 19; 26 to the conditioning apparatus 06, e.g. either directly via conveying means of one conveyor device 19, or via the alignment apparatus 07, and optionally via conveying means of a second conveyor device 26. In the case of web-format printing material 02, these means can be forcibly driven or non-driven rollers over which the printing material 02 is or can be guided. In the preferred case of sheet-format printing material 02, i.e. individual printing material sheets 02 passing through the press 01, sheet-conveying means are provided as the conveying means.

In an embodiment that is not shown, these sheet-conveying means can be formed by one or more transfer cylinders or drums, which receive the printing material sheets 02 from the printing unit 04, e.g. from the impression cylinder 17, and deliver them, optionally via one or more additional transfer cylinders or drums, and optionally via the alignment apparatus 07 and/or via an additional printing unit, to the intake side of the conditioning apparatus 06. In an advantageous embodiment shown here, e.g. at least the conveyor device 19; 26 that is located upstream of the cooling device 09, but for example the first and optionally the second conveyor device 19; 26, is embodied as a circulating gripper conveyor 19; 26 with circulating continuous tractive means, e.g. known as a chain gripper system 19; 26, which comprises, on both frame sides, circulating continuous tractive means 21; 27, e.g. continuous chains 21; 27, which support holding means 22; 28, e.g. gripper bars 22; 28, extending transversely to the present direction of transport T. The gripper bars 22; 28 can grip the leading ends of sheets, thus enabling the printing material sheets 02 to be transported along the conveyor path and delivered to the corresponding conveying or receiving means at the intended location. A sprocket wheel 23; 24; 29; 31, also called a chain gripper wheel 23; 24; 29; 31, is preferably located at least in the region where the printing material sheet 02 is received from the printing unit 04, and in the receiving region of the cooling device 09 and, if provided, in the receiving region of the alignment apparatus 07 and in the delivery region thereof.

Figure 3:
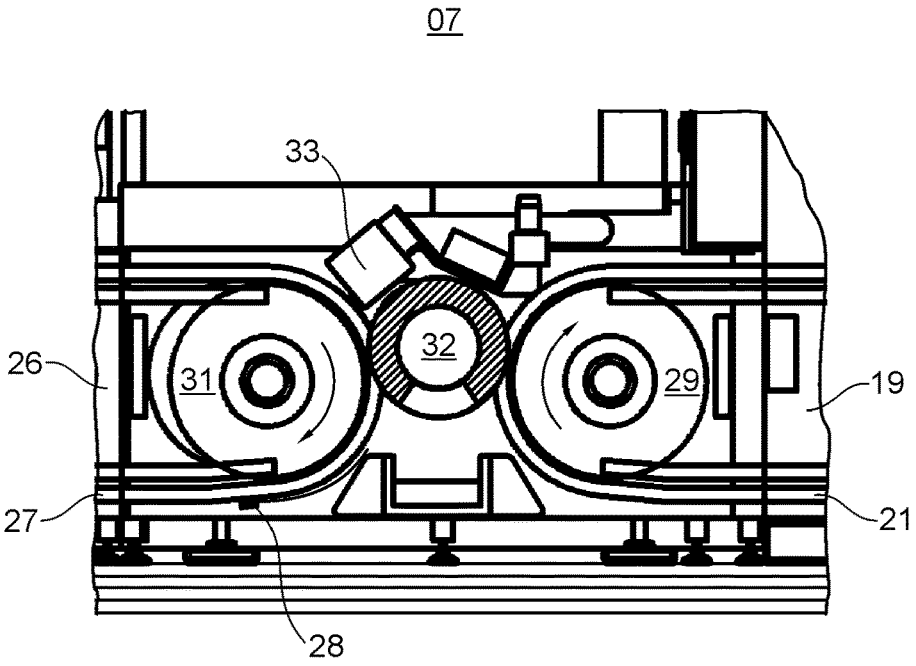
FIG. 3 an enlarged illustration of the apparatus for aligning magnetic or magnetizable particles from FIG. 1.

The preferably provided alignment apparatus 07 (see, e.g., FIG. 3) preferably comprises a cylinder 32, which, in the region of its outer circumference, has a plurality of elements that induce a magnetic field, e.g. permanent magnets or electromagnets, magnetic elements for short, which serve to orient at least some of the magnetic or magnetizable particles of the coating medium that has been applied to the printing substrate 02 passing through. In the case of the aforementioned plurality of copies per substrate section or substrate sheet 02, multiple rows of magnetic elements spaced apart from one another transversely to the direction of transport T are provided circumferentially, and when rolled off against the substrate 02, correspond to the pattern of image elements to be exposed to magnetic fields on the substrate 02. The cylinder 32 comprising the magnetic elements is also referred to here as a magnetic cylinder 32. With the depicted guidance of the substrate 02 such that its first side faces outward during its transport over the first cylinder 32, the particles are aligned or oriented by means of the magnetic elements through the substrate 02.

In the embodiment of the printing press 01 that comprises the alignment apparatus 07, at least one drying and/or curing device 33 is or can be arranged on the transport path of the substrate 02 to be conveyed through the alignment apparatus 07, preferably on the first side of said substrate, e.g. the side having the optically variable coating medium. Said drying and/or curing device is preferably directed toward a circumferential surface segment of the magnetic cylinder 32 that lies in the transport path, as viewed in the direction of transport T. The drying and/or curing device 33 is preferably embodied as a radiation dryer 33 and operates on the basis of electromagnetic radiation, e.g. with IR or preferably UV radiation. For this purpose, it has one or more radiation sources, e.g. IR or preferably UV light sources, especially UV LEDs. The drying and/or curing device 33 is preferably configured to act on the substrate 02 in multiple sections spaced apart from one another transversely to the direction of transport T.

In the substrate path, on the transport path leading away from the alignment apparatus 07, a further drying and/or curing device 34 may be provided, which is of a different type, for example, from the drying and/or curing device 08 arranged directly upstream of the cooling device 09, and/or which in a refinement may be included, as least functionally, as part of the conditioning apparatus 06. This further, e.g. IR-based or preferably hot air-based drying and/or curing device 34 comprises one or more dryers, e.g. one or more IR radiation sources or in particular one or more hot air dryers, directed toward the first side of the printing material 02.

Figure 4:
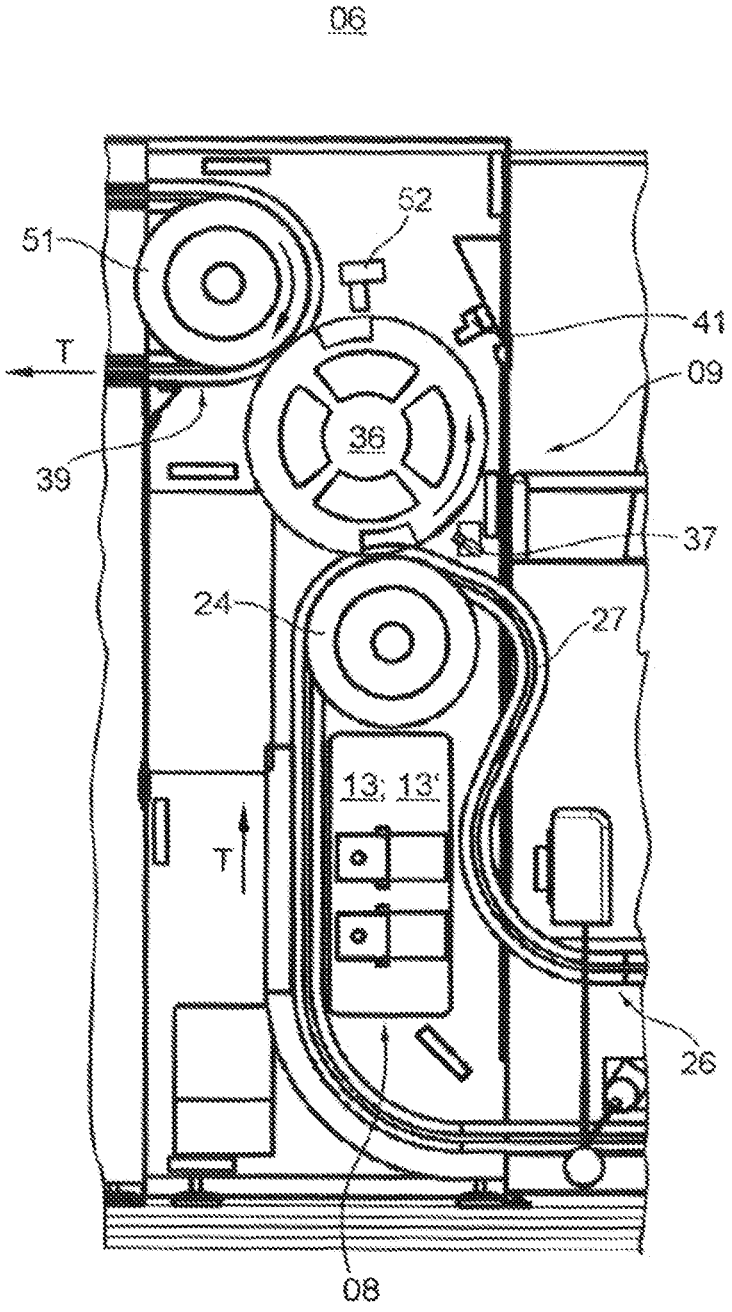
FIG. 4 a side view into the apparatus for conditioning substrate that has been printed upstream.

The cooling device 09 comprised, e.g., by the conditioning apparatus 06 has a guiding and/or transport means 36 for guiding and/or conveying substrate 02, with a stationary or preferably moved-along, coolable supporting and/or guiding surface, in particular a rotating transport means 36, e.g. a cylinder 36 configured as a transport cylinder 36, which has at least one cylinder circumference section to be cooled from the inside by coolant, and via which the substrate 02 is conveyed from a point at which the substrate runs up onto the transport means 36 to a point at which the substrate 02 runs back off of the circumferential surface of the transport means 36 (see, e.g., FIG. 4). In the alternative embodiment having a stationary supporting and/or guiding surface, the guiding and/or transport means 36 may be a cooled guide plate, for example, which is then preferably formed with a friction-reducing surface, e.g. is coated with friction-reducing agents.

In the case of a web-format substrate 02, the substrate wraps around the preferably rotating guiding and/or transport means 36 over a length or in an angular segment that extends between the points where substrate runs up onto and off of said transport means, wherein in the case of a rotating transport means 36, the circumferential section that is or is to be cooled then preferably extends around the entire circumference. In an advantageous embodiment involving a sheet-format substrate 02, the substrate 02 runs up onto said transport means in the region where a leading end of the substrate sheet 02 is received from conveying means of the upstream conveyor device 19; 26 by holding means 38, e.g. grippers of one or more gripper bars 38, provided on the rotating transport means 36, and runs off again in the region where a sheet is delivered or transferred to conveying means of a downstream conveyor device 39.

The rotating transport means 36 is preferably configured as a cylinder 36, or cooling cylinder 36 for short, which is to be cooled from the inside and which preferably has a coolant infeed 47 and coolant discharge on the cylinder end face. This coolant infeed 47 is embodied, for example, as a rotary feedthrough. Inflow and outflow can be formed coaxially with one another. In the preferred embodiment as a sheet-fed printing press and/or with sheet-format substrate 02, the cooling cylinder 36 comprises on its outer circumference one or more holding means 38 configured as gripper bars 38. The cooling cylinder 36 is preferably configured as multi-sectional, in particular as having two sections, i.e. as having a circumference for receiving multiple, in particular two substrate sheets 02 and/or as having multiple, in particular two gripper bars 38 arranged one behind the other on its circumference. This ensures a longer contact time, while at the same time reducing the centrifugal forces acting on the substrate sheet 02.

Downstream of the cooling cylinder 36, in the case of sheet-format substrate 02, a conveyor device 39 is provided, for example, in the form of a circulating gripper conveyor 39 with circulating continuous tractive means, e.g. embodied as a chain gripper system 39. Said conveyor device is associated with the product receiving unit 05, for example, and conveys the substrate sheet 02 above a stacking space of the product receiving unit 05, where it is or can be delivered to a pile to be formed there.

On the substrate path directly at the point where substrate runs up onto the stationary or preferably moved-along cooled supporting and/or guiding surface of the guiding and/or transport means 36, in particular onto the outer circumference of the coolable rotating transport means 36, and/or in the region on the substrate path where the substrate 02 is received, or at a point on the substrate path downstream of said region, an electrode 37, e.g. a high voltage electrode 37, is arranged directed toward the substrate path in such a way that when an electric voltage is applied, in particular an operating voltage, substrate 02 being guided on the substrate path past the electrode 37, in particular a substrate sheet 02 being guided past the electrode 37, is or can be electrostatically charged. In a refinement, at a distance downstream another electrode 41 of this type, e.g. a high voltage electrode 41, may be provided, directed onto the substrate path on the guiding and/or transport means 36, in particular on the cylinder outer circumference.

The electrode 37; 41 employs electrostatic forces to pull the substrate 02, in particular the substrate sheet 02, toward the supporting and/or guiding surface, in particular the outer circumference of the rotating and cooled transport means 36, in particular the cooling cylinder 36, thereby effecting an improved transfer of heat and, if applicable, counteracting a lifting, induced by gravitational and/or centrifugal force, e.g. of a trailing substrate sheet section of the substrate sheet 02, which is held at its leading end, for example.

In a preferred embodiment, the electrode 37; 41 is arranged on the transport path spaced apart from the outer circumference of the guiding and/or transport means 36, in particular the cooling cylinder 36, such that no physical contact occurs between the printing material sheet 02 being transported on the transport path and the electrode 37; 41 in question. A distance from the circumferential surface carrying the printing material sheet 02 of, e.g. at least 30 mm, advantageously at least 40 mm, in particular at least 50 mm is provided for this purpose, for example. The electrode 37; 41 is preferably arranged on the frame that supports the guiding and/or transport means 36 in the printing press 01 or in the machine section or in the module 06 in such a way that the distance between electrode 37; 41 and guiding and/or transport means 36 is adjustable at least in the radial direction. The supporting or circumferential surface of the guiding and/or transport means 36, in particular cooling cylinder 36, that cooperates with an electrode 37; 41 and serves to support the printing material sheet 02 is electrically conductive at least in regions, e.g. is formed by metal segments or preferably as sheet metal that is continuous over at least the length of the printing material.

To ensure, for example, that the substrate 02 will rest as early as possible against the circumferential surface of the guiding and/or transport means 36, configured as a cooling cylinder 36, and/or will be held in an anti-gravitational manner, it is particularly advantageous for the electrode 37, e.g. the first electrode, to lie, e.g. no more than 60°, in particular no more than 45°, preferably no more than 30° downstream, as viewed in the production direction of rotation of the cooling cylinder 36, of the point at which the sheet is picked up from the preceding conveyor device 19; 26 and/or for said electrode to be directed onto the surface of the cooling cylinder 36 lying in the transport path in the region of the lower half of said cylinder. The latter is particularly advantageous when the point at which sheets are picked up from the upstream conveyor device 19; 26 lies on the lower half of the cooling cylinder 36.

To counteract a premature gravity-induced release and/or to effect an intermediate renewal of forces, for example, it is particularly advantageous for a second electrode 41 to lie approximately, i.e. +/−15°, halfway between the run-up or receiving point and the run-off or transfer point to the subsequent conveyor device 39, as viewed in the direction of rotation of the cooling cylinder 36. In the interest of clarity, the point at which sheets are picked up or received onto the cooling cylinder 36 is understood here, e.g. as the point at which the circumferential line of the cooling cylinder 36 is intersected by the plane connecting the axes of rotation of the cooling cylinder 36 and the rotating conveying means comprised by the preceding conveyor device 19; 26, e.g. the sprocket wheel 24; 29, or in another embodiment a transport cylinder. Similarly, the point at which sheets are delivered or transferred is understood, e.g. as the point at which the circumferential line of the cooling cylinder 36 is intersected by the plane connecting the axes of rotation of the cooling cylinder 36 and the rotating conveying means comprised by the subsequent conveyor device 39, e.g. a sprocket wheel 51, e.g. chain gripper wheel 51, or in another embodiment a transport cylinder.

The electrode 37; 41, as viewed in the axial direction of the cooling cylinder 36, preferably has a plurality of spaced apart electrode tips 42, e.g. at least 20, which are preferably spaced apart from one another in pairs by a distance that is shorter than the distance to the outer circumference of the transport means. These generate high field line densities at their tips. For example, a linear tip number density of 80 to 120 tips per meter is provided. The voltage applied during operation or to be provided for operation is at least 20 kV, for example, preferably even more than 25 kV. For this purpose, the electrode 37; 41 is connected to a generator that supplies the corresponding voltage.

In a particularly advantageous refinement, a device 43; 44; 46 that assists with the positioning of the substrate 02 against the circumferential surface is provided upstream of the electrode 37; 41, as viewed in the circumferential direction of the cooling cylinder 36. Said device is preferably located no more than 25°, in particular no more than 15°, upstream of the relevant electrode 37; 41, as viewed in the circumferential direction of the cooling cylinder 36, and thus assists with the positioning of the printing substrate sheet 02 against the cooling cylinder 36 and/or counteracts any unintended physical contact between printing material sheet 02 and electrode 37; 41.

Figure 5:
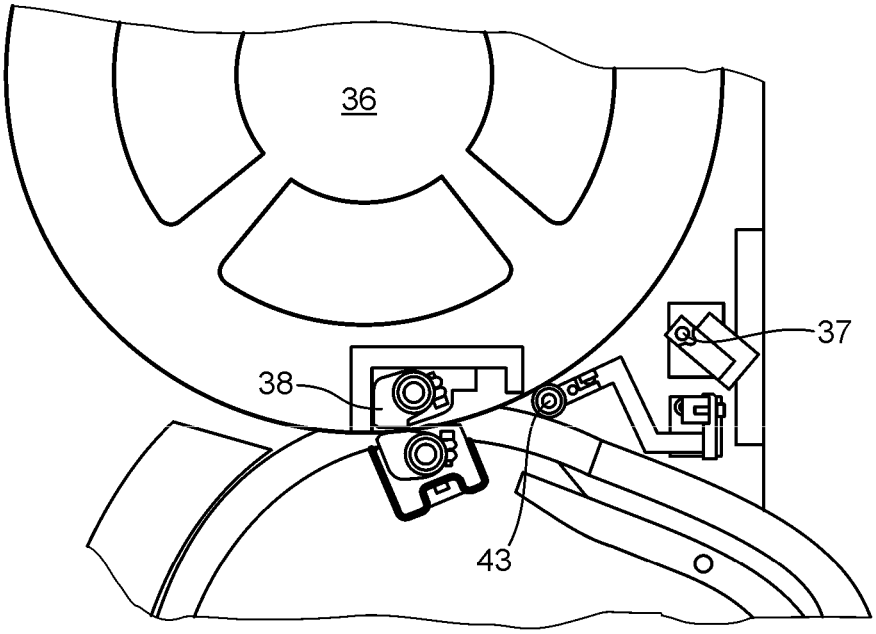
FIG. 5 a detailed view from FIG. 4 focused on the receiving point and the means downstream for improving the positioning of the substrate, according to FIG. 5, in a first variant.

As is clear from FIG. 5, for example, said device 43; 44; 46 may be a roller 43, which can be set against the circumferential surface and which is located upstream of the electrode 37; 41 in the substrate path and/or is mounted on the frame or on the electrode 37; 41 such that it can be set against and removed from said circumferential surface.

Figure 6:
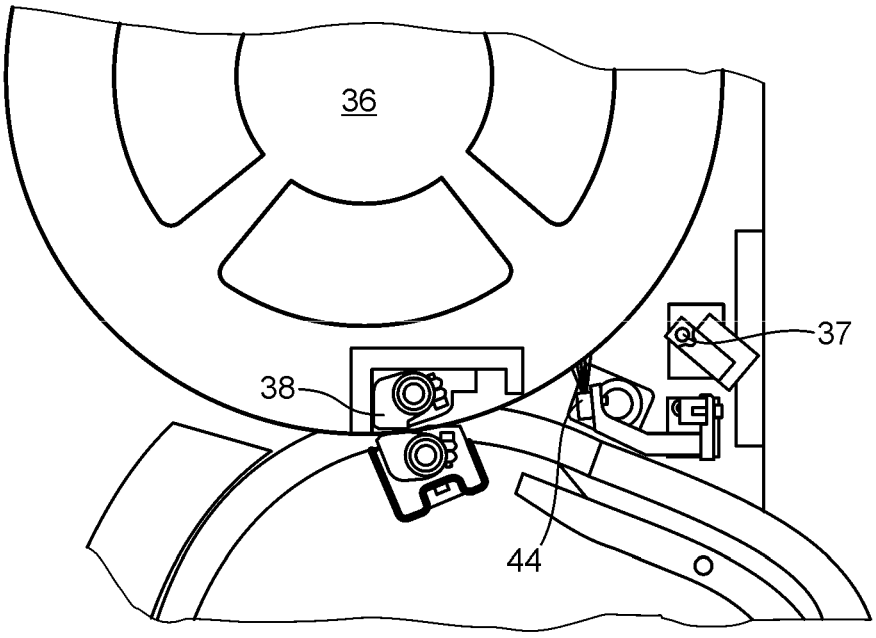
FIG. 6 a detailed view focused on the receiving point and the means downstream for improving the positioning of the substrate, in a second variant.

In one variant, a brush 44 that is or can be set against the circumferential surface may be provided as the device 44 that assists with positioning of the substrate 02, said brush being located upstream of the electrode 37; 41 in the substrate path and/or being mounted on the frame such that it can be set against and removed from said circumferential surface (see, e.g., FIG. 6).

Figure 7:
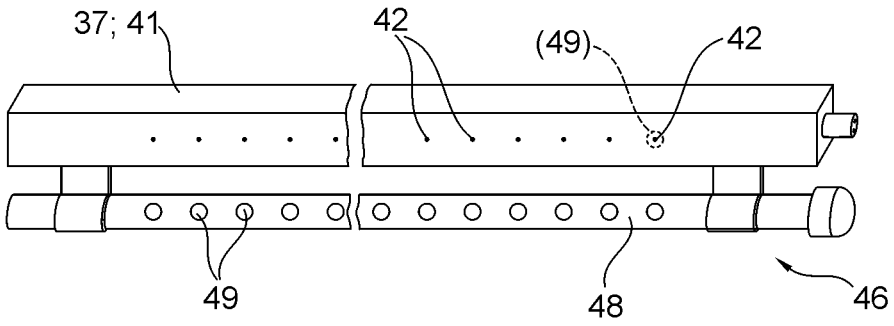
FIG. 7 a view of the side facing the transport means of an electrode having a blower device as a further variant for improving positioning.
Figure 8:
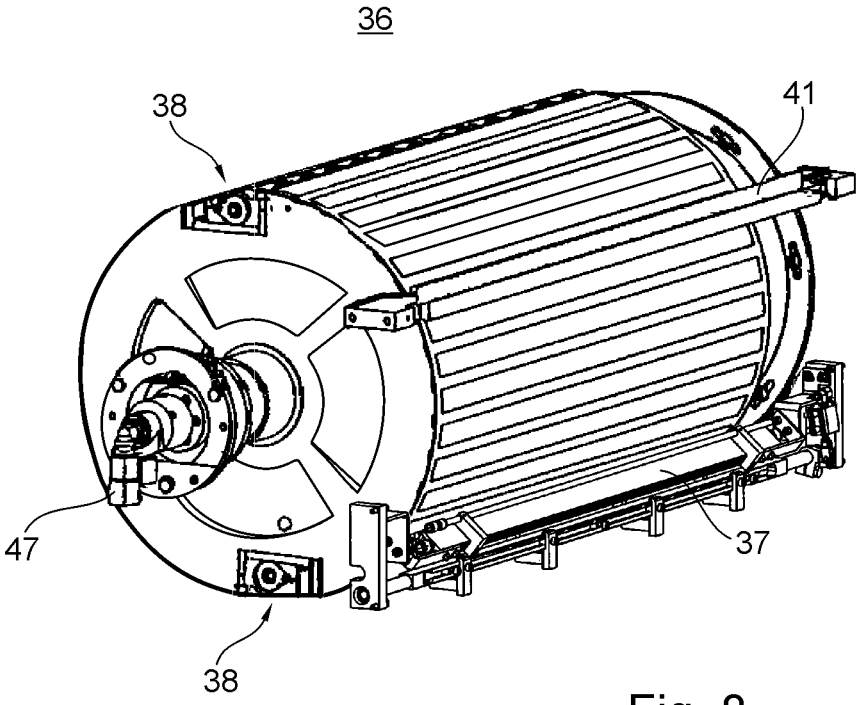
FIG. 8 an oblique view of the cooling cylinder with a first and a second electrode and a connection point for the coolant infeed.

In a third variant, e.g. shown in FIG. 7, a blower device 46 may be provided as the device 46 that assists with the positioning of the substrate 02. Said blower device is located upstream of the electrode 37; 41 in the substrate path and/or, as shown here, may be arranged on the electrode 37; 41 mounted on the frame. As an alternative to a specifically dedicated blower bar 48 having a plurality of blower openings 49, the blower device 46 may be integrated into the housing of the electrode 37; 41, in that, for example, the side facing the cooling cylinder 36 comprises both the electrode tips 42 and blower air openings 49. The latter can surround the electrode tips 42 in the form of a ring, for example.

It is also possible for a combination of these devices 43; 44; 46 to be provided, e.g. a blower device 46 along with a roller 43 and/or a brush 44.

In a refinement that is advantageous with respect to an improved release during the transfer to the subsequent conveyor device 39 and/or for the delivery process, in addition to the first and optionally the second electrode 37; 41 a further electrode 52 that acts as a discharge electrode 52 and/or that has the inverse polarity or is grounded, e.g. a high voltage electrode 52, is provided. The polarity of said electrode is reversed from the preceding electrode 37; 41, for example, so that charge carriers carried on the substrate 02 are at least partially removed again, thereby reducing and ideally even eliminating the electrostatic charge. The discharge electrode 52, particularly if it is located downstream of the first and optionally the second electrode 37; 41 on the outer circumference of the cooling cylinder 36, is provided at a distance, e.g. of no more than 60°, in particular no more than 45°, preferably even no more than 30°, from the point of transfer to a conveyor device 39 following the cooling cylinder 36.

The above specifications relating to the configuration of the electrodes 37; 41 that assist with positioning apply similarly to the discharge electrode 52. However, the distance from the circumferential surface can advantageously be smaller than with the aforementioned electrode 37; 41, e.g. a distance of at least 10 mm, in particular at least 15 mm, and/or of at most 40 mm, in particular at most 30 mm, preferably 20±3 mm.

In place of the aforementioned discharge electrode 52, it is also possible for a contact with an electrically conductive and grounded stripping device to be provided, via which the charge carriers carried along on the substrate 02 can be stripped away.

While preferred embodiments of a printing press and a method for producing printing products, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. A printing press comprising:

at least a first printing unit that comprises one or more printing couples, by the use of which at least first printing unit sheet-format substrate can be printed on at least one side in at least one printing nip;

at least one product receiving unit located after, in a direction of a substrate travel path, the at least first printing unit and in which the printed sheet-format substrate can be collected to form one of bundles of products and intermediate products;

a rotatable cooling cylinder for one of guiding and conveying the sheet-format substrate, the rotatable cooling cylinder being located upstream of the at least one product receiving unit and downstream of the at least one printing unit comprising the one or more printing couples in the direction of the substrate travel path, the rotatable cooling cylinder having an outer circumferential surface defining a section of the substrate travel path;

at least a first electrode spaced apart from and directed toward the section of the substrate travel path that runs over the outer circumferential section of the rotatable cooling cylinder, whereby, when an electric voltage is applied to the substrate path, by the at least first electrode, the substrate being guided along the substrate path past the at least first electrode one of is and can be electrostatically charged; and an assistant substrate positioning device that physically positions the substrate against the circumferential surface of the rotatable cooling cylinder, the assistant substrate positioning device being different from the at least first electrode and being positioned upstream of the at least first electrode in the substrate travel path at a maximum angle of 25° with respect to the at least first electrode, as viewed in a circumferential direction of the rotatable cooling cylinder.

2. The printing press according to claim 1, one of wherein the at least first electrode lies no more than 60° downstream of a first point at which the sheet-format substrate is received from an upstream conveyor device onto the rotatable cooling cylinder in the substrate travel path and wherein the sheet-format substrate is directed toward a surface of the rotatable cooling cylinder in a region of a lower half of the surface of the rotatable cooling cylinder.

3. The printing press according to claim 1, wherein a second electrode is directed toward the substrate travel path on the rotatable cooling cylinder, the second electrode one of lying between a first point at which the sheet-format substrate is received by the rotatable cooling cylinder and a second point at which the sheet-format substrate runs off of the rotatable cooling cylinder and is transferred to a subsequent conveyor device and lying at a maximum distance of halfway, +/−15°, between the first point at which the substrate is received by the rotatable cooling cylinder and the second point at which the substrate runs off of the rotatable cooling cylinder and is transferred to the subsequent conveyor device.

4. The printing press according to claim 1, one of wherein a further electrode that one of acts as a discharge electrode and that has a polarity inverse to a polarity of the at least first electrode, and is grounded, is provided and wherein an electrically conductive stripping device is provided and is located on an outer circumference of the rotatable cooling cylinder at a distance of no more than 45° from a point of transfer of the sheet-format substrate from the rotatable cooling cylinder to a conveyor device that follows the rotatable cooling cylinder.

5. The printing press according to claim 1, wherein the rotatable cooling cylinder one of is configured as multi-sectional with respect to the substrate sections to be transported, and is configured such that coolant can flow through it.

6. The printing press according to claim 1, wherein the rotatable cooling cylinder has, on its outer circumferential surface, at least one substrate holding device configured as gripper bars, on which gripper bars the sheet-format substrate can be received from a first conveyor and a first transport cylinder arranged upstream of the rotatable cooling cylinder and configured as a first circulating gripper conveyor, and from the first circulating gripper conveyor the sheet-format substrate can be transferred to grippers of a second conveyor configured as one of a second circulating gripper conveyor and a transport cylinder that follows downstream of the first circulating gripper conveyor.

7. The printing press according to claim 1, one of wherein a first one of the one or more printing couples is configured as a screen printing couple, and wherein an alignment apparatus, for aligning ones of magnetic or magnetizable particles contained in an applied coating medium, is provided between the at least first printing unit and the rotatable cooling cylinder.

8. The printing press according to claim 1, wherein the at least first electrode one of has a plurality of electrode tips spaced apart from one another as viewed transversely to a direction of the substrate travel path (T), and can be adjusted in terms of its distance from the substrate travel path, and is connected to a generator that supplies a voltage of at least 20 kV.

9. The printing press according to claim 1, wherein one of a drying device and a curing device is located upstream of the rotatable cooling cylinder in the substrate travel path.

10. The printing press according to claim 9, wherein the rotatable cooling cylinder and the one of the drying device and the curing device are one of included as part of a conditioning apparatus and are arranged in a common frame in the form of a conditioning apparatus embodied as a module and connecting an upstream conveyor line to an intake of the product receiving unit.

11. A method for producing one of products and intermediate products in a printing press including;

supplying a sheet-format substrate to be processed on an intake side of the printing press using a printing material infeed;

printing the sheet-format substrate in a printing unit of the printing press using one or more printing couples;

conveying the printed sheet-format substrate along a transport path over one of a cooled supporting and guiding surface of a guiding device and a transport device configured as a rotatable cooling cylinder to a product receiving unit, where the printed sheet-format substrate is combined to form product bundles;

charging the sheet-format substrate electrostatically using a first electrode directed toward, and spaced apart from a point on a section of the transport path that runs over an outer circumferential surface of the rotatable cooling cylinder;

assisting a positioning of the substrate on the one of the cooled supporting and guiding surface by electrostatic forces using the first electrode; and providing an assistant substrate positioning device, the assistant substrate positioning device being different from the first electrode and being positioned upstream of the first electrode in the travel path at a maximum angle of 25°, as viewed in a circumferential direction of the rotatable cooling cylinder and;

using the assistant substrate positioning device, for physically positioning the substrate against the circumferential surface of the rotating cooling cylinder upstream of the first electrode.

12. The method according to claim 11, including charging the substrate using the first electrode at a location that one of lies no more than 60° downstream of a point at which sheets of the substrate are picked up from an upstream conveyor device, as viewed in a production direction of rotation, and that lies in a region of a lower half of the rotatable cooling cylinder, on a surface of the rotatable cooling cylinder lying in the transport path.

13. The method according to claim 11, one of including charging the substrate using a second electrode located downstream of the first electrode on the substrate path section of the guiding and transport means, and including discharging the substrate, at a downstream point on the substrate path section that runs over the rotatable cooling cylinder one of by using a second electrode, which second electrode one of acts as a discharge electrode and has an inverse polarity and is grounded, and by using an electrically conductive stripping device.

14. The printing press according to claim 1, wherein the assistant substrate positioning device is at least one of a roller and a brush and a blower.

15. The method of claim 11, including providing the assistant substrate positioning device as at least one of a roller and a brush and a blower.

* * * * *